US009115883B1

(12) United States Patent
Martin et al.

(10) Patent No.: US 9,115,883 B1
(45) Date of Patent: Aug. 25, 2015

(54) VARIABLE LENGTH LAMP

(71) Applicant: C-M Glo, LLC, Watertown, WI (US)

(72) Inventors: John D. Martin, Watertown, WI (US); Aaron W. Smith, Watertown, WI (US)

(73) Assignee: C-M Glo, LLC, Watertown, WI (US)

( * ) Notice: Subject to any disclaimer, the term of this patent is extended or adjusted under 35 U.S.C. 154(b) by 120 days.

(21) Appl. No.: 13/933,564

(22) Filed: Jul. 2, 2013

Related U.S. Application Data

(60) Provisional application No. 61/673,034, filed on Jul. 18, 2012.

(51) Int. Cl.
*F21V 21/00* (2006.01)
*F21V 21/34* (2006.01)

(52) U.S. Cl.
CPC ..... *F21V 21/34* (2013.01)

(58) Field of Classification Search
CPC ..... F21V 21/34
USPC ..... 362/285, 371
See application file for complete search history.

(56) References Cited

U.S. PATENT DOCUMENTS

| | | | | |
|---|---|---|---|---|
| 6,343,871 | B1 * | 2/2002 | Yu | 362/249.03 |
| 7,810,945 | B2 | 10/2010 | Mize | |
| D647,223 | S | 10/2011 | Katsaros | |
| 8,047,685 | B2 | 11/2011 | Wu et al. | |
| 2011/0299286 | A1 | 12/2011 | Chang et al. | |
| 2013/0215620 | A1 * | 8/2013 | Zhou | 362/285 |

* cited by examiner

*Primary Examiner* — David V Bruce
(74) *Attorney, Agent, or Firm* — Boyle Fredrickson, S.C.

(57) ABSTRACT

A lamp that houses an illumination source such as, for example, a number of light emitting diodes (LEDs), is selectively adjustable to vary the length of the lamp to accommodate a number of installation types and configurations. The single lamp housing design meets all the required lamp standards and can be used interchangeably within fixtures requiring differed lamp lengths. The lamp includes a base that is configured to be coupled to a power source of a lamp fixture. The lamp has a neck coupled to the base and a housing arrangement this is movable relative to the neck that can move between an extended and retracted position via a guide arrangement.

24 Claims, 7 Drawing Sheets

VARIABLE LENGTH LAMP

CROSS-REFERENCE TO RELATED APPLICATIONS

This application is based on and claims priority to U.S. provisional patent application Ser. No. 61/673,034 filed Jul. 18, 2012, the entirety of which is hereby expressly incorporated by reference.

BACKGROUND AND SUMMARY

This invention relates broadly to an illuminating lamp and, more particularly, to a lamp that houses an illumination source such as, for example, a number of light emitting diodes (LEDs), and which is selectively adjustable to vary the length of the lamp to accommodate a number of installation types and configurations.

A typical illuminating lamp comes in predetermined standard shapes and sizes which are meant to fit a majority of residential and commercial light fixtures. These predetermined shapes and sizes have become known as the industry standard for lamp housings. The availability of different sizes depends largely on the lamp shape, e.g., Arbitrary (A-series), Cylindrical (C-series), and Parabolic reflector (PAR-series), and the corresponding size demands of the consumer.

For example, Parabolic Aluminum Reflector (PAR) lamps are widely used in commercial, residential, and transportation illumination. PAR lamps exhibit the same general parabolic shape and generally are sold in the following standard sizes: PAR-16 (2 inch diameter), PAR-20 (2.5 inch diameter), PAR-30S (3.75 inch diameter), PAR-30L (3.75 inch diameter), PAR-36 (4.5 inch diameter), PAR-38 (4.75 inch diameter), PAR-46 (5.75 inch diameter), PAR-56 (7 inch diameter), PAR-64 (8 inch diameter). The PAR-30S and PAR-30L are the same diameter but come in "short" and "long" neck versions, as indicated by the "S" and "L", respectively, which are meant to accommodate different fixture sizes. These size variations may be especially important if the light socket is inset in a wall or ceiling, and generally inflexible to differing lamp sizes.

For consumers who require a lamp size that differs from the industry standards, e.g., different length neck or base, it has been a requirement for these lamps to be specially manufactured to the desired size. This is burdensome for the consumer and the manufacturer since the general components of the lamp housing remain the same. The only part that differs is the neck length.

For consumers who have many differently sized light fixtures that require differently sized lamps, it has also been a requirement to keep an inventory of many different lamp shapes and sizes. This can be expensive and space consuming given the great variety of lamp shapes and sizes available on the market.

It is an object of the present invention to provide an illuminating lamp with a selectively variable neck or base in order to accommodate different light fixtures or lamp configurations. It is a further object of the invention to provide a single lamp housing design meeting all the required standards, e.g., American National Standards Institute (ANSI) standards, which can be interchangeable within fixtures requiring different lamp lengths.

In accordance with one aspect of the present invention, a lamp includes a base that is able to be coupled to a power source, a neck which is coupled to the base, and a housing arrangement that is selectively movable relative to the neck by a guide arrangement that is interposed between the neck and housing for moving the housing arrangement between an extended position and a retracted position.

In one embodiment the guide arrangement may include a slot and a channel. In one embodiment there may be at least one rib movably coupled to at least one slot, and at least one projection movably coupled to the at least one channel.

In one embodiment the housing arrangement may have a shoulder element with an engagement arrangement which is configured to engage the guide arrangement for movement of the housing arrangement relative to the neck.

In one embodiment the housing arrangement may be coupled to the neck and to a housing where the housing supports a cover element and a lens element.

In one embodiment of the housing arrangement the guide arrangement has two longitudinally extending slots and two longitudinally extending channels. The two longitudinally extending slots are circumferentially spaced from one another and the two longitudinally extending channels are circumferentially spaced from one another and the slots.

In one embodiment the housing arrangement is selectively moveable to at least one intermediate position between the extended and retracted positions.

The invention also contemplates a method of lamp length adjustment, in which a lamp substantially in accordance with the foregoing summary is selectively adjusted to a desired length.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate the best mode presently contemplated of carrying out the invention. In the drawings.

Figure 1:
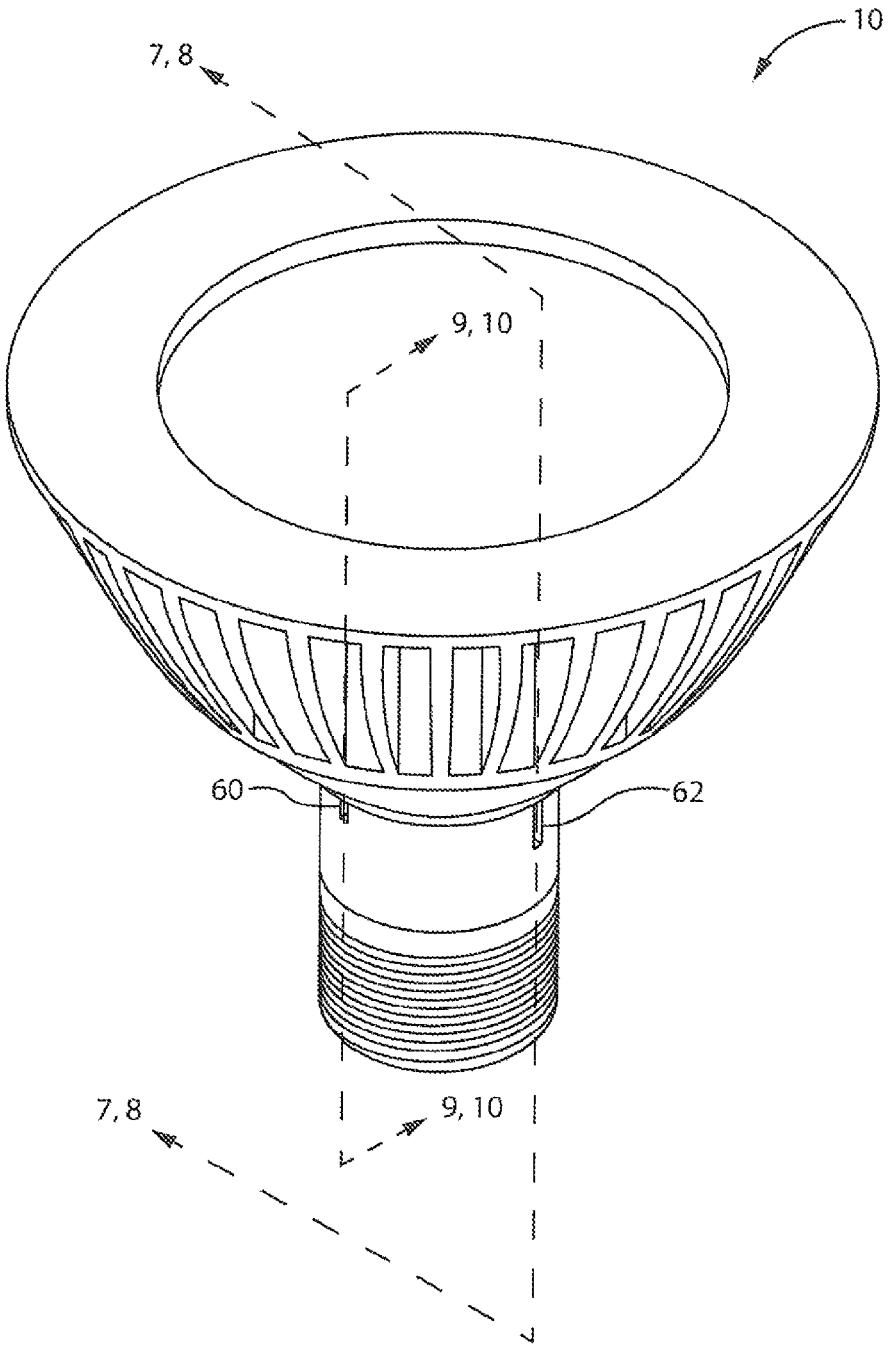
FIG. 1 is an isometric view of a variable length lamp having an extendable and retractable base in accordance with a first embodiment of the present invention.
Figure 2:
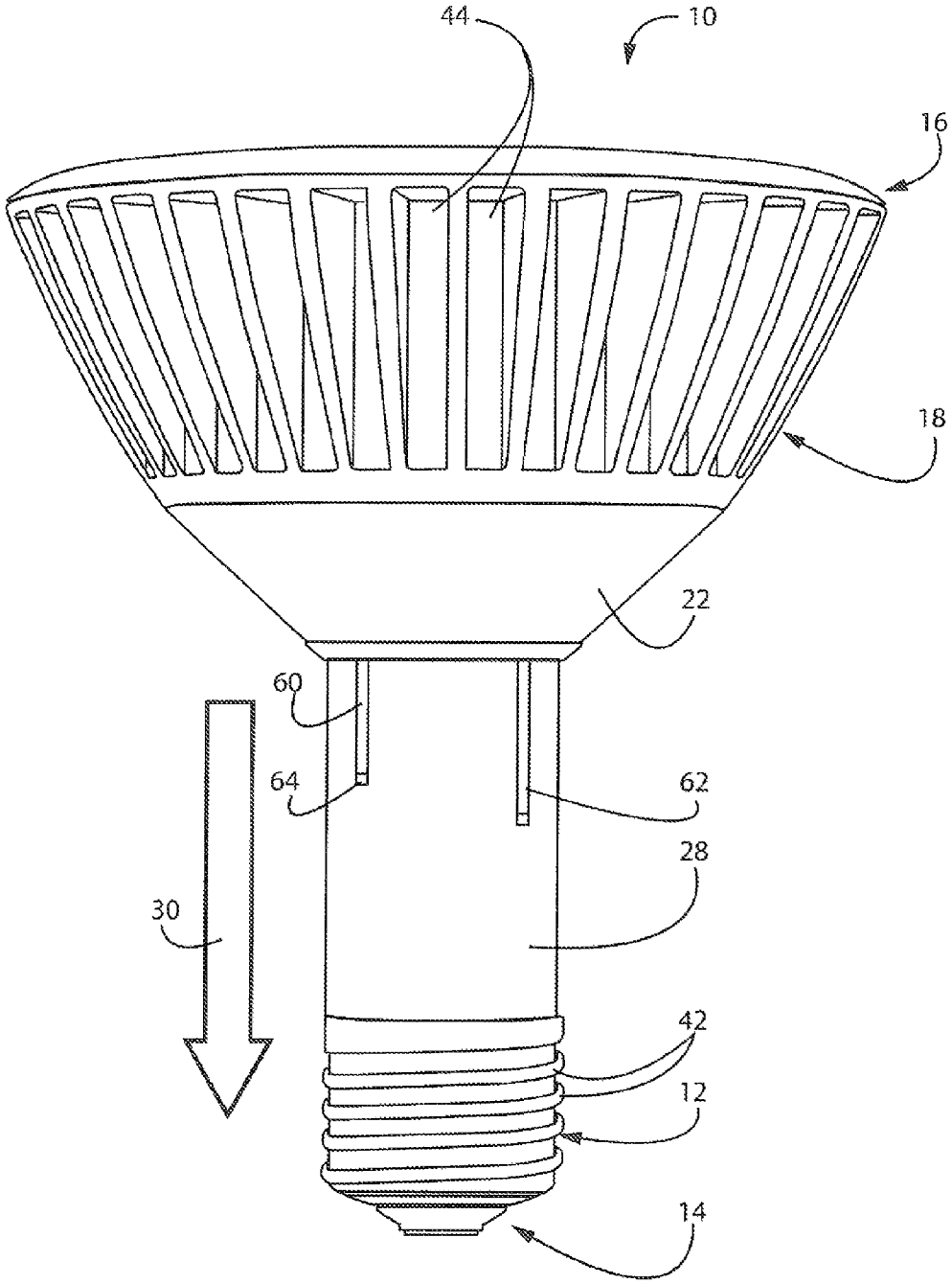
FIG. 2 is a side elevation view of the variable length lamp of FIG. 1 showing the base in an extended position.
Figure 3:
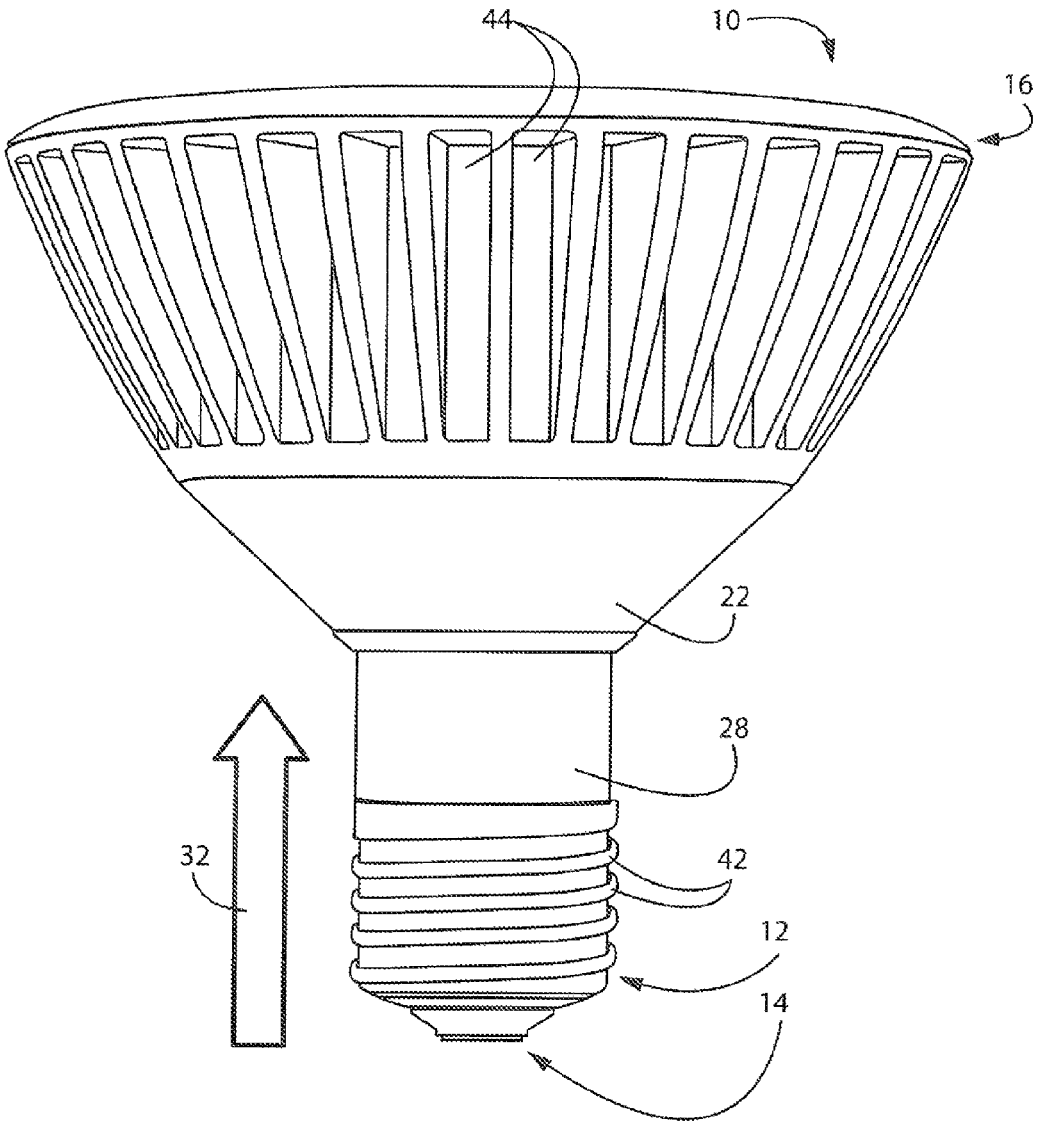
FIG. 3 is a side elevation view of the variable length lamp of FIG. 1 showing the base in a retracted position.
Figure 4:
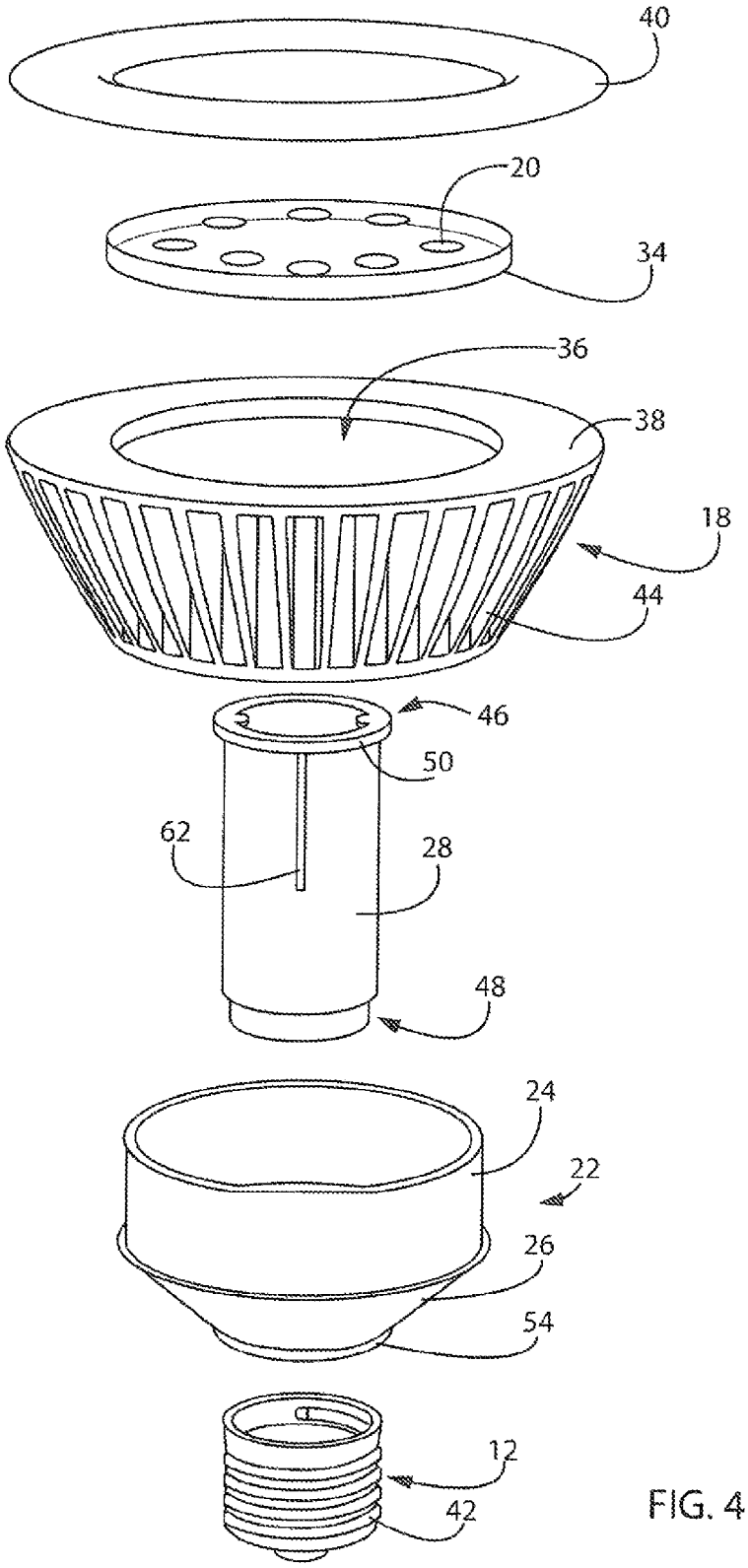
FIG. 4 is an exploded isometric view of the variable length lamp of FIG. 1.

In describing the embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION

This invention relates to an illuminating lamp and, more particularly, to a lamp that houses an illumination source such as, for example, a number of light emitting diodes (LEDs), and which is selectively adjustable to vary the length of the lamp to accommodate a number of installation types and configurations.

With reference to FIGS. 1-4, a lamp 10 in accordance with the present invention includes a base 12 at one end 14 opposite a second end 16 that includes a housing 18 that contains an illumination source, shown here as a number of LEDs 20, but understandably, the illumination source may be any type of electrical illumination source known in the art or subsequently developed. The housing 18 may also function as a heat sink for the lamp 10 that dissipates the heat generated by the lamp 10 into the surrounding air. The lower end of housing 18 is coupled to a shoulder element 22 at an upper end portion 24 of the shoulder element 22. The upper end portion 24 may have a generally circular cross-section and may be configured to be received within a corresponding recessed opening of the housing 18 (see FIGS. 7-10) to secure the upper end portion 24 to the housing 18. Understandably, the upper end portion 24 may have a cross-section of any alternative shape, such as polygonal, oval, and the like. The shoulder element 22 and the housing 18 together define an interior in which the electronics (not shown) necessary for operation of the lamp 10 may be contained.

A lower end portion 26 of the shoulder element 22 opposite the upper end portion 24 may be movably coupled to a neck element 28 to adjust the length of the lamp 10 between an extended configuration (FIG. 2) and a retracted configuration (FIG. 3) as designated by arrows 30 and 32 and as will be described in further detail herein. The lower end portion 26 may be frustoconically shaped as shown or may be otherwise suitably shaped. In the extended position, the housing 18 and the shoulder element 22 are positioned at a maximum predetermined distance from the base 12, and in the retracted position, the housing 18 and the shoulder element 22 are positioned at a minimum predetermined distance from the base 12. In the extended position, the relative length of the lamp 10 is greater than in the retracted position, which enables it to be used in lighting situations that may call for a longer lamp 10 or lamp base 12 while still enabling the lamp to be moved to its retracted position to be used where a shorter lamp 10 or lamp base 12 may be desired. In this manner, a single lamp 10 may accommodate a multitude of needs, which greatly reduces inventory and purchasing costs associated with providing differently sized lamps. It is to be understood that the lamp 10 may alternatively be constructed to be positioned at a number of additional or intermediate positions to provide even greater configurability.

The lamp 10 further includes a light emitting element 34, which may securely house the LEDs 20 and any supporting structure such as a printed circuit board or the like, or otherwise be configured to direct light emitted by the LEDs 20 in a desired manner, such as outward through the lamp 10 opening or lens. The lighting element 34 may be securely received within a recess 36 defined by an upper end 38 of the housing 18. The lighting element 34 may be secured within the recess 36 by any suitable means such as mechanical fasteners, adhesives, or the like. A cover element 40 may be coupled to at least a portion of the upper end 38. As shown, the cover element 40 may be ring-shaped and circumferentially disposed about the upper end 38, and may include an opening or lens through which light transmitted by the LEDs 20 passes.

The base 12 may be a standard light bulb base as shown or may be any other type of base configured to couple the lamp 10 to a source of electricity for powering the LEDs 20 for illumination thereof. Representatively, the base 12 may include a number of threads 42 for threading the base 12 into a socket (not shown) coupled to a power source for providing power to the lamp 10. A variable length conductor (not shown) extends between the base 12 and the light source 34 for supplying power to the light source 34 when the base 12 is coupled to a power source. The variable length conductor may be contained within the passage defined by the neck element 28, and may be in the form of, for example, a coil-type or accordion-type ribbon or wire conductor.

The housing 18 may be a standard lamp housing of the kind generally known in the art and may serve as a heat sink. For instance, the housing 18 may include a number of fins 44 circumferentially formed in an exterior surface of the housing 18. The fins 44 may be configured to dissipate heat generated by the electronics of the lamp 10 by increasing the surface area in contact with the ambient air surrounding the lamp 10 as is generally understood in the art.

The neck element 28 includes an upper end 46 and a lower end 48 opposite the upper end 46 and may be cylindrically constructed over at least a portion therebetween. The lower end 48 may be generally narrower relative to the rest of the neck 28 and configured to couple the base 12 to the lower end 48, and the upper end 46 may include a flanged portion 50 configured to engage the shoulder element 22. The lower end 48 may include a cutout or recessed portion circumferentially extending around the lower end and configured to be securely engaged by an upper edge of the base 12 to secure the base 12 to the neck element 28. Understandably, any other suitable manner of coupling the base 12 and the neck 28 to one another is within the scope of the invention.

Figure 5:
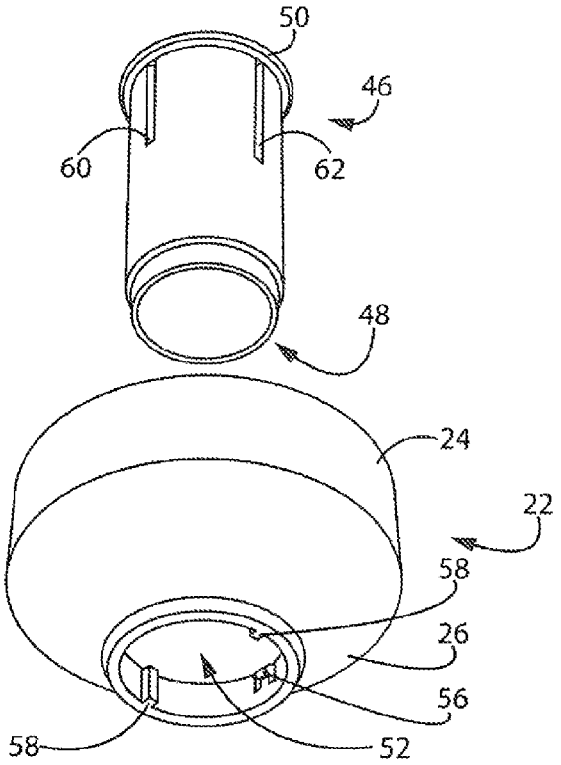
FIG. 5 is an exploded bottom isometric view of the neck element and shoulder element of the variable length lamp and showing the connections therebetween.
Figure 6:
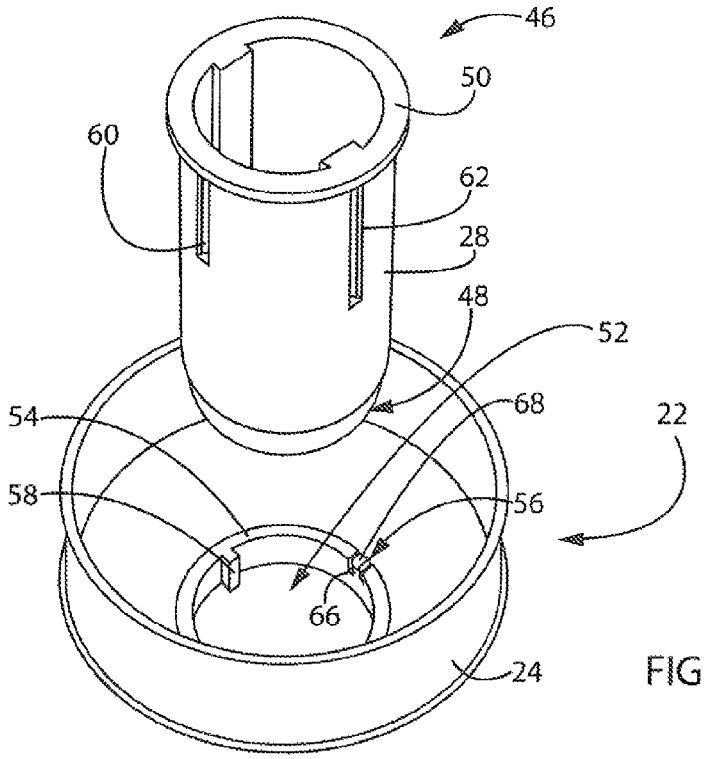
FIG. 6 is an exploded top isometric view of the neck element and shoulder element of the variable length lamp.

With additional reference now to FIGS. 5-6, the neck element 28 may be inserted through an aperture 52 of the shoulder 22 until the flange portion 50 engages a corresponding upper edge of a shoulder flange portion 54 configured to catch the upper end 46 to prevent the neck element 28 from being pulled entirely through the aperture 52. The shoulder flange portion 54 includes a pair of opposing bump elements 56 and a pair of similarly opposed rib elements 58 that are interposed between each of the respective bump elements 56. That is, the bump elements 56 are generally spaced 180 degrees relative one another and 90 degrees relative to each of the rib elements 58. Correspondingly, the rib elements 58 are spaced 180 degrees relative to one another while being spaced 90 degrees relative to the bump elements 56. Understandably, alternative arrangements and spacing may be used in constructing the lamp 10 of the present invention.

Each of the bump elements 56 is configured to operably engage a corresponding longitudinally extending channel 60 disposed on the neck element 28. The rib elements 58 are configured to operably engage a corresponding longitudinally extending slot 62 disposed on the neck element 28. The channels 60 may be relatively shallow as compared to the slots 62, or in one construction of the lamp 10, the channels 60 may be devoid altogether and the bump elements 56 may simply move along the outer surface of the neck 28. The channels 60 have a pair of longitudinally spaced indentations 64 configured to securely receive the bump elements 56 to act as a detent and secure the lamp 10 in either the extended or retracted position as will be described in additional detail (see FIGS. 9-10). In the embodiment in which the neck 28 is devoid of channels 60, the indentations 64 may be formed into the side walls of the neck element 28. The slots 62 may define a deeper recess into the body of the neck element 28 and may be sized and shaped to entirely receive the rib elements 58 therein to maintain engagement between the shoulder element 22 and the neck element 28. The slots 62 may be longer than the channels 60 and thereby extend further downward on the neck element 28 to accommodate for the relative lengths of the rib elements 58 as compared to the bump elements 56. In addition, the rib elements 58 are sized and configured to engage the slots 62 to prevent rotation of the neck element 28 relative to the shoulder element 22.

The bump elements 56 include a generally longitudinally extending portion 66 that may be integrally formed with the shoulder flange portion 54 and which may include spaces on opposing sides thereof. The longitudinally extending portion 66 terminates at its upper end in a head portion 68 that extends perpendicularly relative to the longitudinally extending portion toward a center of the aperture 52. The medial end of the head portion 68 is configured to engage the indentations 64 of the channels 60 as will later be described (see FIGS. 9-10). The rib elements 58 may be integrally formed with the shoulder flange portion 54 and extend perpendicularly with respect thereto toward the center of the aperture 52 for engaging the respective slots 62. The rib elements 58 as shown have a rectangular cross-sectional shape although it is understood that any number of alternative shapes may be used.

Figure 7:
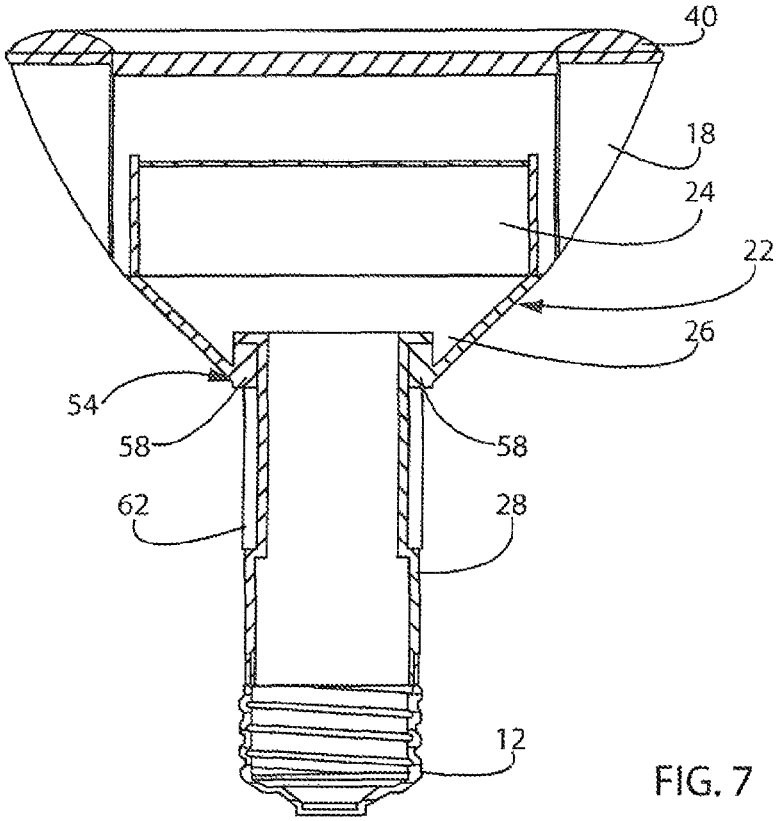
FIG. 7 is a sectional view taken along a cross section as indicated at line 7-7- in FIG. 1 showing the base in an extended position.
Figure 8:
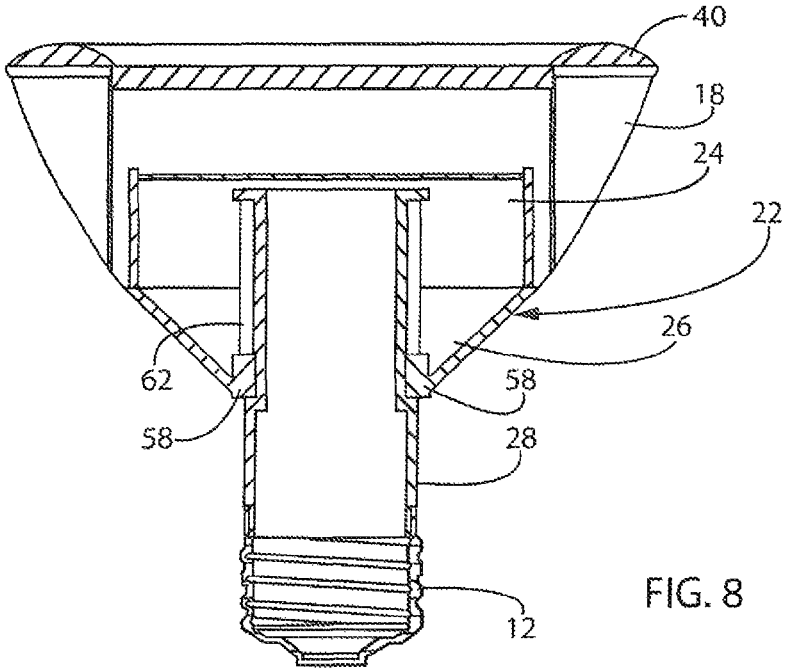
FIG. 8 is a sectional view taken along the cross section as indicated at line 8-8 in FIG. 1 showing the base in a retracted position.
Figure 9:
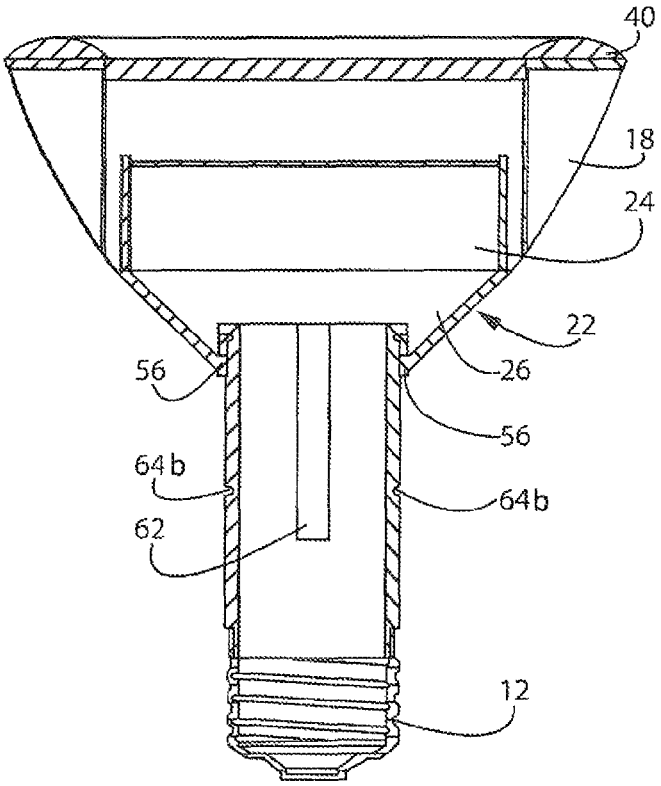
FIG. 9 is a sectional view taken along a the cross section at line 9-9 as indicated in FIG. 1 showing the base in an extended position.
Figure 10:
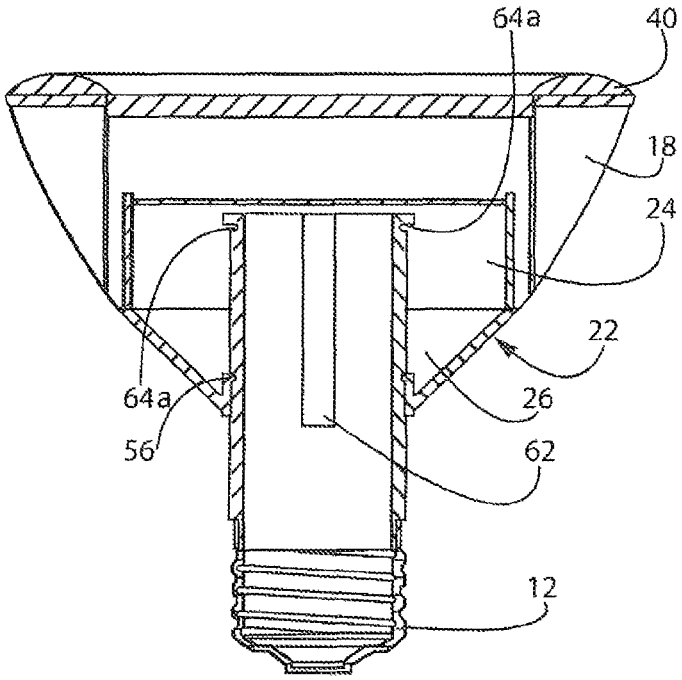
FIG. 10 is a sectional view taken along the cross section at line 10-10 as indicated in FIG. 1 showing the base in a retracted position.

With additional reference now to FIGS. 7-10, showing the cross-sections as depicted in FIG. 1, the lamp 10 is shown in the extended and retracted positions, respectively, and the relative positions of the rib elements 58 within the slots 62 in each of the positions. When the lamp 10 is in the extended position as shown in FIGS. 7 and 9, the rib elements 58 are positioned at an upper end of the slots 62 and the bump elements 56 are engaged with the upper indentation 64*a* to secure the shoulder element 22 relative to the neck 28. In the retracted position as shown in FIGS. 8 and 10, the rib elements 58 are positioned at a lower end of the slots 62, and the bump elements 56 are engaged with the lower indentation 64*b* in the same manner.

In operation, to move the lamp from the extended position to the retracted position, the shoulder element 22 is moved downwardly relative to the neck 28 so the neck 28 is received within the interior space defined by the shoulder element 22 and particularly the upper end portion 24 leaving a relatively small portion of the neck element 28 exposed to the user. Once the shoulder element 22 has been moved to the fully retracted position, the medial portions of the bump elements 56 engage the respective indentations 64 to secure the shoulder element 22 relative to the neck element 28 so the lamp 10 may not be accidentally or otherwise undesirably moved from the retracted position. To move the lamp 10 from the retracted position to the extended position, the user applies an axial force that moves the shoulder element 22 upward relative to the neck element 28 to withdraw a greater portion of the neck element 28 through the aperture 52 until the respective upper indentations 64*a* are engaged by the medial portions of the bump elements 56 to secure the shoulder element 22 and the neck element 28 to one another as previously described. As may be appreciated, the lamp 10 may be alternatively constructed to include any number of additional, intermediate indentations 64 to configure the lamp 10 in any number of additional intermediate positions as may be desired. It can be appreciated that the bump elements and indentations may be reversed, such that the bump elements are on the neck element 28 and the indentations are on the shoulder element 22.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A lamp comprising:

a base configured to be removably coupled to a power source;

a neck having a substantially round cross-section coupled to the base; and a housing arrangement that is selectively movable relative to the neck via a guide arrangement interposed between the neck and the housing for movement of the housing arrangement between an extended position and a retracted position wherein the guide arrangement is circumferentially spaced around the neck to allow axial movement of the neck along an axis substantially parallel to a length of the lamp and provide a fixed rotational engagement of the neck relative to the housing arrangement, wherein the housing arrangement includes a light arrangement that is adapted to be powered by the power source through the base.

2. The lamp of claim 1, wherein the guide arrangement comprises at least one slot and at least one channel.

3. The lamp of claim 2, wherein the housing arrangement comprises at least one rib movably coupled to the at least one slot and at least one projection movably coupled to the at least one channel.

4. The lamp of claim 1, wherein the housing arrangement comprises a shoulder element including an engagement arrangement configured to engage the guide arrangement for movement of the housing arrangement relative to the neck.

5. The lamp of claim 1, wherein the housing arrangement comprises a shoulder element coupled to the neck and coupled to a housing, wherein the housing supports a cover element and a lens element.

6. The lamp of claim 1, wherein the neck comprises at least two longitudinally extending slats circumferentially spaced from one another and at least two longitudinally extending channels circumferentially spaced from one another and the slots.

7. The lamp of claim 6, wherein the housing arrangement comprises at least two rib elements movably coupled with each of the respective slots and at least two projections movably coupled with each of the respective channels.

8. The lamp of claim 7, wherein each channel comprises at least two spaced indents configured to releasably receive the respective projection for securing the housing arrangement in one of the extended and retracted position.

9. The lamp of claim 1, wherein the housing arrangement is selectively movable to at least one intermediate position between the extended and retracted positions.

10. A lamp comprising:

a base configured to be removably coupled to a power source;

a housing including a light arrangement adapted to be powered by the power source; and a variable length connection structure interposed between the base and the housing, wherein the variable length connection structure has a substantially round cross section and is configured and arranged to vary an overall axial length of the lamp between a first end defined by the base and a second end defined by the housing, wherein a guide arrangement is interposed between the variable length connection structure and the housing and is circumferentially spaced around the variable length connection structure, wherein the guide arrangement is configured to allow axial movement of the variable length connection structure along an axis substantially parallel to a length of the lamp and provide a fixed rotational engagement of the variable length connection structure relative to the housing.

11. The lamp of claim 10 wherein the variable length connection structure comprises a neck secured to the base and movably interconnected with the housing for movement between an extended position and a retracted position.

12. The lamp of claim 11 wherein the guide arrangement guides movement of the neck between the extended and retracted positions.

13. The lamp of claim 12 wherein the base includes threads for providing threaded engagement with a threaded power source, and wherein the guide arrangement is configured and arranged to transfer a rotational force from the housing to the base through the neck for threadedly engaging the base with the power source.

14. The lamp of claim 13 wherein the guide arrangement comprises a projection and slot arrangement interposed between the neck and the housing.

15. The lamp of claim 11 further comprising a retainer arrangement interposed between the neck and the housing for selectively maintaining the neck in the retracted position and in the extended position.

16. The lamp of claim 15, wherein the retainer arrangement comprises a projection and indent arrangement interposed between the neck and the housing at each of the retracted and extended positions of the neck.

17. A method of adjusting the length of a lamp having a base, a neck having a substantially round cross-section coupled to the base, and a housing containing a light arrangement comprising the steps of:

selectively moving the housing relative to the base to a desired position within a range of positions defined by and between an extended position and a retracted position, wherein a guide arrangement interposed between the neck and the housing is circumferentially spaced around the neck and is configured to allow axial movement of the neck along an axis substantially parallel to a length of the lamp and provide a fixed rotational engagement of the neck relative to the housing; and selectively retaining the housing in the desired position.

18. The method of claim 17 wherein the step of selectively moving the housing relative to the base is carried out by axially moving the neck relative to the housing, wherein the base is secured to the neck.

19. The method of claim 18, wherein the step of selectively retaining the housing in the desired position is carried out using a selectively engageable retainer arrangement interposed between the neck and the housing.

20. A lamp comprising:

a base configured to be removably coupled to a power source;

a neck coupled to the base; and a housing arrangement that is selectively movable relative to the neck via a guide arrangement interposed between the neck and the housing arrangement for movement of the housing arrangement between an extended position and a retracted position, wherein the housing arrangement includes a light arrangement that is adapted to be powered by the power source through the base, and wherein the guide arrangement comprises at least one slot and at least one channel.

21. A lamp comprising:

a base configured to be removably coupled to a power source;

a neck coupled to the base; and a housing arrangement that is selectively movable relative to the neck via a guide arrangement interposed between the neck and the housing arrangement for movement of the housing arrangement between an extended position and a retracted position, wherein the housing arrangement includes a light arrangement that is adapted to be powered by the power source through the base, and wherein the housing arrangement comprises a shoulder element coupled to the neck and coupled to a housing, wherein the housing arrangement supports a cover element and a lens element.

22. A lamp comprising:

a base configured to be removably coupled to a power source;

a housing including a light arrangement adapted to be powered by the power source;

a variable length connection structure interposed between the base and the housing, wherein the variable length connection structure is configured and arranged to vary an overall axial length of the lamp between a first end defined by the base and a second end defined by the housing, wherein the variable length connection structure comprises a neck secured to the base and movably interconnected with the housing for movement between an extended position and a retracted position; and a guide arrangement interposed between the neck and the housing for guiding movement of the neck between the extended and retracted positions wherein the base includes threads for providing threaded engagement with a threaded power source, and wherein the guide arrangement is configured and arranged to transfer a rotational force from the housing to the base through the neck for threadedly engaging the base with the power source; and wherein the guide arrangement comprises a projection and slot arrangement interposed between the neck and the housing.

23. A lamp comprising:

a base configured to be removably coupled to a power source;

a housing including a light arrangement adapted to be powered by the power source;

a variable length connection structure interposed between the base and the housing, wherein the variable length connection structure is configured and arranged to vary an overall axial length of the lamp between a first end defined by the base and a second end defined by the housing, wherein the variable length connection structure comprises a neck secured to the base and movably interconnected with the housing for movement between an extended position and a retracted position; and a retainer arrangement interposed between the neck and the housing for selectively maintaining the neck in the retracted position and in the extended position.

24. A method of adjusting the length of a lamp having a base and a housing containing a light arrangement comprising the steps of:

selectively moving the housing arrangement relative to the base to a desired position within a range of positions defined by and between an extended position and a retracted position; and selectively retaining the housing arrangement in the desired position;

wherein the step of selectively moving the housing arrangement relative to the base is carried out by axially moving a neck relative to the housing arrangement, wherein the base is secured to the neck; and wherein the step of selectively retaining the housing arrangement in the desired position is carried out using a selectively engageable retainer arrangement interposed between the neck and the housing arrangement.

* * * * *